US010941674B2

(12) United States Patent
Budnick et al.

(10) Patent No.: US 10,941,674 B2
(45) Date of Patent: Mar. 9, 2021

(54) MULTI-PIECE HEAT SHIELD

(71) Applicant: United Technologies Corporation, Farmington, CT (US)

(72) Inventors: Matthew Budnick, Hudson, NH (US); Conway Chuong, Manchester, CT (US); Jonathan Ariel Scott, Southington, CT (US); Darrell Weidner, Carthage, IN (US); Chris Bates, Jupiter, FL (US)

(73) Assignee: Raytheon Technologies Corporation, Waltham, MA (US)

( * ) Notice: Subject to any disclaimer, the term of this patent is extended or adjusted under 35 U.S.C. 154(b) by 179 days.

(21) Appl. No.: 16/389,193

(22) Filed: Apr. 19, 2019

(65) Prior Publication Data

US 2019/0249568 A1 Aug. 15, 2019

Related U.S. Application Data

(63) Continuation of application No. 14/655,833, filed as application No. PCT/US2013/076392 on Dec. 19, 2013, now Pat. No. 10,294,819.

(Continued)

(51) Int. Cl.

| | |
|---|---|
| ***F01D 25/14*** | (2006.01) |
| ***F01D 25/24*** | (2006.01) |
| ***F01D 25/16*** | (2006.01) |

(52) U.S. Cl.

CPC ..... *F01D 25/145* (2013.01); *F01D 25/162* (2013.01); *F01D 25/24* (2013.01);

(Continued)

(58) Field of Classification Search

CPC ..... F01D 25/145; F01D 25/24; F01D 25/28; F01D 25/30; F02C 7/24; F02K 1/822

See application file for complete search history.

(56) References Cited

U.S. PATENT DOCUMENTS

| | | | |
|---|---|---|---|
| 2,214,108 | A | 9/1940 | Nichols |
| 2,869,941 | A | 1/1959 | Shoup, Jr. et al. |

(Continued)

FOREIGN PATENT DOCUMENTS

| | | | |
|---|---|---|---|
| CH | 705513 | A2 | 3/2013 |
| EP | 2187019 | A1 | 5/2010 |

(Continued)

OTHER PUBLICATIONS

International Search Report and Written Opinion for PCT Application No. PCT/US2013/076392, dated Apr. 10, 2014, p. 13.

*Primary Examiner* — Ninh H. Nguyen
*Assistant Examiner* — Cameron A Corday
(74) *Attorney, Agent, or Firm* — Kinney & Lange, P. A.

(57) ABSTRACT

An assembly for a gas turbine engine includes a first casing, a second casing, and struts extending from the first casing to support the second casing. The assembly further includes a fairing and a multi-piece heat shield assembly. The fairing is disposed between the first casing and the second casing and around each of the struts. The multi-piece heat shield assembly includes a first shield extending between the first casing and the fairing, and a second shield extending between the fairing and the first casing. The multi-piece heat shield assembly further includes a third shield extending between the fairing and the second casing, and fourth and fifth heat shields extending from the third heat shield between the fairing and each of the struts.

20 Claims, 12 Drawing Sheets

Related U.S. Application Data

(60) Provisional application No. 61/747,239, filed on Dec. 29, 2012.

(52) U.S. Cl.
CPC .... *F05D 2220/32* (2013.01); *F05D 2230/232* (2013.01); *F05D 2230/60* (2013.01); *F05D 2240/15* (2013.01); *F05D 2260/231* (2013.01); *Y10T 29/49321* (2015.01)

(56) References Cited

U.S. PATENT DOCUMENTS 2,928,648 A 3/1960 Haines et al.
3,576,328 A 4/1971 Vose
3,802,046 A 4/1974 Wachtell et al.
3,970,319 A 7/1976 Carroll et al.
4,009,569 A 3/1977 Kozlin
4,044,555 A 8/1977 McLoughlin et al.
4,088,422 A 5/1978 Martin
4,114,248 A 9/1978 Smith et al.
4,305,697 A 12/1981 Cohen et al.
4,321,007 A 3/1982 Dennison et al.
4,369,016 A 1/1983 Dennison
4,478,551 A 10/1984 Honeycutt, Jr. et al.
4,645,217 A 2/1987 Honeycutt, Jr. et al.
4,678,113 A 7/1987 Bridges et al.
4,738,453 A 4/1988 Ide
4,756,536 A 7/1988 Belcher
4,793,770 A 12/1988 Schonewald et al.
4,920,742 A * 5/1990 Nash ..... F02K 1/82 60/799
4,987,736 A 1/1991 Ciokajlo et al.
4,989,406 A 2/1991 Vdoviak et al.
4,993,918 A 2/1991 Myers et al.
5,031,922 A 7/1991 Heydrich
5,042,823 A 8/1991 Mackay et al.
5,071,138 A 12/1991 Mackay et al.
5,076,049 A 12/1991 Von Benken et al.
5,100,158 A 3/1992 Gardner
5,108,116 A 4/1992 Johnson et al.
5,169,159 A 12/1992 Pope et al.
5,174,584 A 12/1992 Lahrman
5,188,507 A 2/1993 Sweeney
5,211,536 A 5/1993 Ackerman et al.
5,211,541 A 5/1993 Fledderjohn et al.
5,236,302 A 8/1993 Weisgerber et al.
5,246,295 A 9/1993 Ide
5,265,807 A 11/1993 Steckbeck et al.
5,269,057 A 12/1993 Mendham
5,271,714 A 12/1993 Shepherd et al.
5,272,869 A 12/1993 Dawson et al.
5,273,397 A 12/1993 Czachor et al.
5,292,227 A 3/1994 Czachor et al.
5,312,227 A 5/1994 Grateau et al.
5,338,154 A 8/1994 Meade et al.
5,357,744 A 10/1994 Czachor et al.
5,370,402 A 12/1994 Gardner et al.
5,385,409 A 1/1995 Ide
5,401,036 A 3/1995 Basu
5,438,756 A 8/1995 Halchak et al.
5,474,305 A 12/1995 Flower
5,483,792 A 1/1996 Czachor et al.
5,558,341 A 9/1996 McNickle et al.
5,597,286 A 1/1997 Dawson et al.
5,605,438 A 2/1997 Burdgick et al.
5,609,467 A 3/1997 Lenhart et al.
5,632,493 A 5/1997 Gardner
5,634,767 A 6/1997 Dawson
5,691,279 A 11/1997 Tauber et al.
5,755,445 A 5/1998 Arora
5,851,105 A 12/1998 Fric et al.
5,911,400 A 6/1999 Niethammer et al.
6,163,959 A 12/2000 Arraitz et al.
6,196,550 B1 3/2001 Arora et al.
6,227,800 B1 5/2001 Spring et al.
6,337,751 B1 1/2002 Kimizuka
6,343,912 B1 2/2002 Manteiga et al.
6,358,001 B1 3/2002 Bosel et al.
6,364,316 B1 4/2002 Arora
6,439,841 B1 8/2002 Bosel
6,463,739 B1 10/2002 Mueller et al.
6,511,284 B2 1/2003 Darnell et al.
6,578,363 B2 6/2003 Hashimoto et al.
6,601,853 B2 8/2003 Inoue
6,612,807 B2 9/2003 Czachor
6,619,030 B1 9/2003 Seda et al.
6,638,013 B2 10/2003 Nguyen et al.
6,652,229 B2 11/2003 Lu
6,672,833 B2 1/2004 MacLean et al.
6,719,524 B2 4/2004 Nguyen et al.
6,736,401 B2 5/2004 Chung et al.
6,792,758 B2 9/2004 Dowman
6,796,765 B2 9/2004 Kosel et al.
6,805,356 B2 10/2004 Inoue
6,811,154 B2 11/2004 Proctor et al.
6,935,631 B2 8/2005 Inoue
6,969,826 B2 11/2005 Trewiler et al.
6,983,608 B2 1/2006 Allen, Jr. et al.
7,055,305 B2 6/2006 Baxter et al.
7,094,026 B2 8/2006 Coign et al.
7,100,358 B2 9/2006 Gekht et al.
7,200,933 B2 4/2007 Lundgren et al.
7,229,249 B2 6/2007 Durocher et al.
7,238,008 B2 7/2007 Bobo et al.
7,367,567 B2 5/2008 Farah et al.
7,371,044 B2 5/2008 Nereim
7,389,583 B2 6/2008 Lundgren
7,614,150 B2 11/2009 Lundgren
7,631,879 B2 12/2009 Diantonio
7,673,461 B2 3/2010 Cameriano et al.
7,677,047 B2 3/2010 Somanath et al.
7,735,833 B2 6/2010 Braun et al.
7,798,768 B2 9/2010 Strain et al.
7,815,417 B2 10/2010 Somanath et al.
7,824,152 B2 11/2010 Morrison
7,891,165 B2 2/2011 Bader et al.
7,909,573 B2 3/2011 Cameriano et al.
7,955,446 B2 6/2011 Dierberger
7,959,409 B2 6/2011 Guo et al.
7,988,799 B2 8/2011 Dierberger
8,069,648 B2 12/2011 Snyder et al.
8,083,465 B2 12/2011 Herbst et al.
8,091,371 B2 1/2012 Durocher et al.
8,092,161 B2 1/2012 Cai et al.
8,152,451 B2 4/2012 Manteiga et al.
8,162,593 B2 4/2012 Guimbard et al.
8,172,526 B2 5/2012 Lescure et al.
8,177,488 B2 5/2012 Manteiga et al.
8,221,071 B2 7/2012 Wojno et al.
8,245,399 B2 8/2012 Anantharaman et al.
8,245,518 B2 8/2012 Durocher et al.
8,282,342 B2 10/2012 Tonks et al.
8,371,127 B2 2/2013 Durocher et al.
8,371,812 B2 2/2013 Manteiga et al.
2002/0182058 A1 12/2002 Darnell et al.
2003/0025274 A1 2/2003 Allan et al.
2003/0042682 A1 3/2003 Inoue
2003/0062684 A1 4/2003 Inoue
2003/0062685 A1 4/2003 Inoue
2005/0046113 A1 3/2005 Inoue
2005/0050898 A1 3/2005 Noda
2006/0010852 A1 1/2006 Gekht et al.
2006/0123796 A1 6/2006 Aycock et al.
2007/0025847 A1 2/2007 Wakazono et al.
2008/0216300 A1 9/2008 Anderson et al.
2010/0054927 A1 3/2010 Almstedt et al.
2010/0132371 A1 6/2010 Durocher et al.
2010/0132374 A1 6/2010 Manteiga et al.
2010/0132377 A1 6/2010 Durocher et al.
2010/0202872 A1 8/2010 Weidmann
2010/0236244 A1 9/2010 Longardner
2010/0275572 A1 11/2010 Durocher et al.
2010/0275614 A1 11/2010 Fontaine et al.

(56) References Cited

U.S. PATENT DOCUMENTS

| | | | |
|---|---|---|---|
| 2010/0307165 | A1 | 12/2010 | Wong et al. |
| 2011/0000223 | A1 | 1/2011 | Russberg |
| 2011/0005234 | A1 | 1/2011 | Hashimoto et al. |
| 2011/0020116 | A1 | 1/2011 | Hashimoto et al. |
| 2011/0061767 | A1 | 3/2011 | Vontell et al. |
| 2011/0081237 | A1 | 4/2011 | Durocher et al. |
| 2011/0081239 | A1 | 4/2011 | Durocher |
| 2011/0081240 | A1 | 4/2011 | Durocher et al. |
| 2011/0085895 | A1 | 4/2011 | Durocher et al. |
| 2011/0214433 | A1 | 9/2011 | Feindel et al. |
| 2011/0262277 | A1 | 10/2011 | Sjoqvist et al. |
| 2011/0302929 | A1 | 12/2011 | Bruhwiler |
| 2012/0111023 | A1 | 5/2012 | Sjoqvist |
| 2012/0156020 | A1 | 6/2012 | Kottilingam et al. |
| 2012/0186254 | A1 | 7/2012 | Ito et al. |
| 2012/0204569 | A1 | 8/2012 | Schubert |
| 2012/0227371 | A1 | 9/2012 | Johnson et al. |
| 2013/0011242 | A1 | 1/2013 | Beeck et al. |
| 2013/0223982 | A1 | 8/2013 | Durocher et al. |
| 2014/0007588 | A1 | 1/2014 | Sanchez et al. |

FOREIGN PATENT DOCUMENTS

| | | | |
|---|---|---|---|
| WO | WO03020469 | A1 | 3/2003 |
| WO | WO2006007686 | A1 | 1/2006 |
| WO | WO2009157817 | A1 | 12/2009 |
| WO | WO2010002295 | A1 | 1/2010 |
| WO | WO2010002296 | A1 | 1/2010 |
| WO | WO2011129724 | A1 | 10/2011 |
| WO | WO2012158070 | A1 | 11/2012 |

* cited by examiner

MULTI-PIECE HEAT SHIELD

CROSS-REFERENCE TO RELATED APPLICATIONS

This application is a Continuation of application Ser. No. 14/655,833, filed Jun. 26, 2015, for "MULTI-PIECE HEAT SHIELD" by M. Budnick, C. Choung, J. A. Scott, D. Weidner and C. Bates; which is a national phase application of PCT International Application No. PCT/US2013/076392, filed Dec. 19, 2013, for "MULTI-PIECE HEAT SHIELD" by M. Budnick, C. Choung, J. A. Scott, D. Weidner and C. Bates; which claims the benefit of Provisional Application No. 61/747,239, filed Dec. 29, 2012, for "MULTI-PIECE HEAT SHIELD" by M. Budnick, C. Choung, J. A. Scott, D. Weidner and C. Bates.

BACKGROUND

The disclosure relates to gas turbine engines, and more particularly to heat shields used in gas turbine engines.

Gas turbine engines operate according to a continuous-flow, Brayton cycle. A compressor section pressurizes an ambient air stream, fuel is added and the mixture is burned in a central combustor section. The combustion products expand through a turbine section where bladed rotors convert thermal energy from the combustion products into mechanical energy for rotating one or more centrally mounted shafts. The shafts, in turn, drive the forward compressor section, thus continuing the cycle. Gas turbine engines are compact and powerful power plants, making them suitable for powering aircraft, heavy equipment, ships and electrical power generators. In power generating applications, the combustion products can also drive a separate power turbine attached to an electrical generator.

For many stator vane assemblies, a fairing is disposed about a frame in order to define a main gas flow path for the gas turbine engine. As the fairing is directly exposed to gas flow, including combustion gases, the fairing can be heated to high temperatures during operation. Heat from the fairing can heat the frame in an undesirable manner.

SUMMARY

An assembly for a gas turbine engine includes a first casing, a fairing, and a multi-piece heat shield assembly. The fairing is disposed adjacent the first casing. The multi-piece heat shield assembly includes a first shield extending between the first casing and the fairing, and a second shield extending between the fairing and the first casing.

A gas turbine engine includes a frame, an annularly shaped fairing, and a multi-piece heat shield. The frame has an inner casing, an outer casing, and struts that extend between the inner casing and outer casing. The annularly shaped fairing is disposed adjacent the frame between the inner casing and the outer casing. The multi-piece heat shield is connected to the frame and the fairing. The multi-piece heat shield includes a first shield that extends between the inner casing and the fairing, a second shield that is spaced from and extends across a portion of the first shield and extends between the fairing and the inner casing, and a third shield that extends between the outer radial casing and the fairing.

DETAILED DESCRIPTION

This application discloses a multi-piece heat shield that is easily assembled within a frame. The multiple pieces of the heat shield overlap with one another or are joined together to eliminate line-of-sight from the fairings. The heat shield design blocks or reduces radiation heating from the frame, including the inner casing and outer casing, and therefore, allows less expensive materials (steel) to be used for those components.

Figure 1:
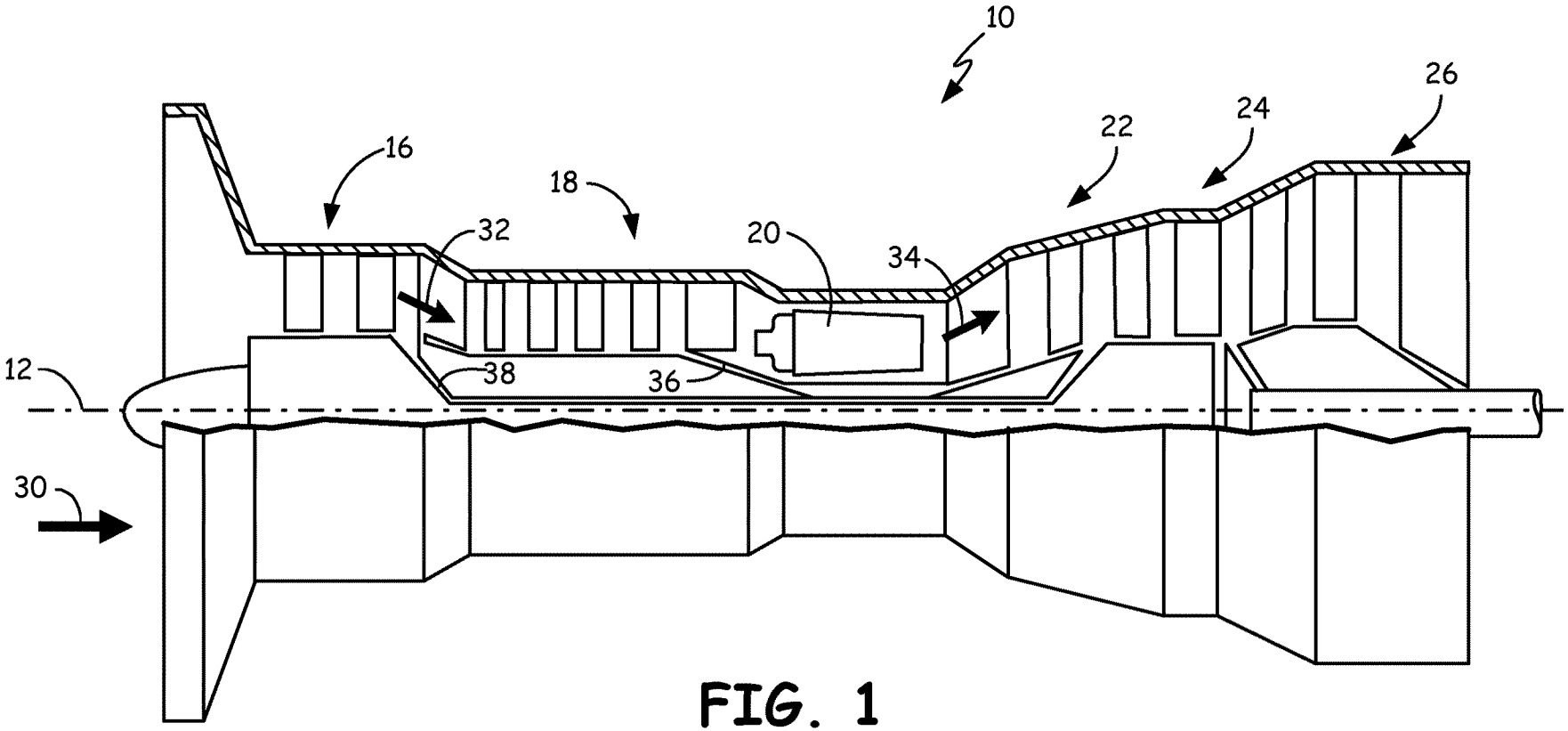
FIG. 1 is an industrial turbine cross-section.

An exemplary industrial gas turbine engine 10 is circumferentially disposed about a central, longitudinal axis or axial engine centerline axis 12 as illustrated in FIG. 1. The engine 10 includes, in series order from front to rear, low and high pressure compressor sections 16 and 18, combustor section 20 and high and low pressure turbine sections 22 and 24. In some examples, free turbine section 26 is disposed aft of low pressure turbine 24. Although illustrated with reference to an industrial gas turbine engine, this application also extends to aero engines with a fan or gear driven fan, and engines with more or fewer sections than illustrated.

In gas turbines, incoming ambient air 30 becomes pressurized air 32 in compressors 16 and 18. Fuel mixes with pressurized air 32 in combustor section 20, where it is burned to produce combustion gases 34 that expand as they flow through turbine sections 22, 24 and power turbine 26. Turbine sections 22 and 24 drive high and low pressure rotor shafts 36 and 38 respectively, which rotate in response to the combustion products and thus attached compressor sections 18, 16. Free turbine section 26 may, for example, drive an electrical generator, pump, or gearbox (not shown).

It is understood that FIG. 1 provides a basic understanding and overview of the various sections and the basic operation of an industrial gas turbine engine. The present application is applicable to all types of gas turbine engines, including those with aerospace applications.

Figure 2:
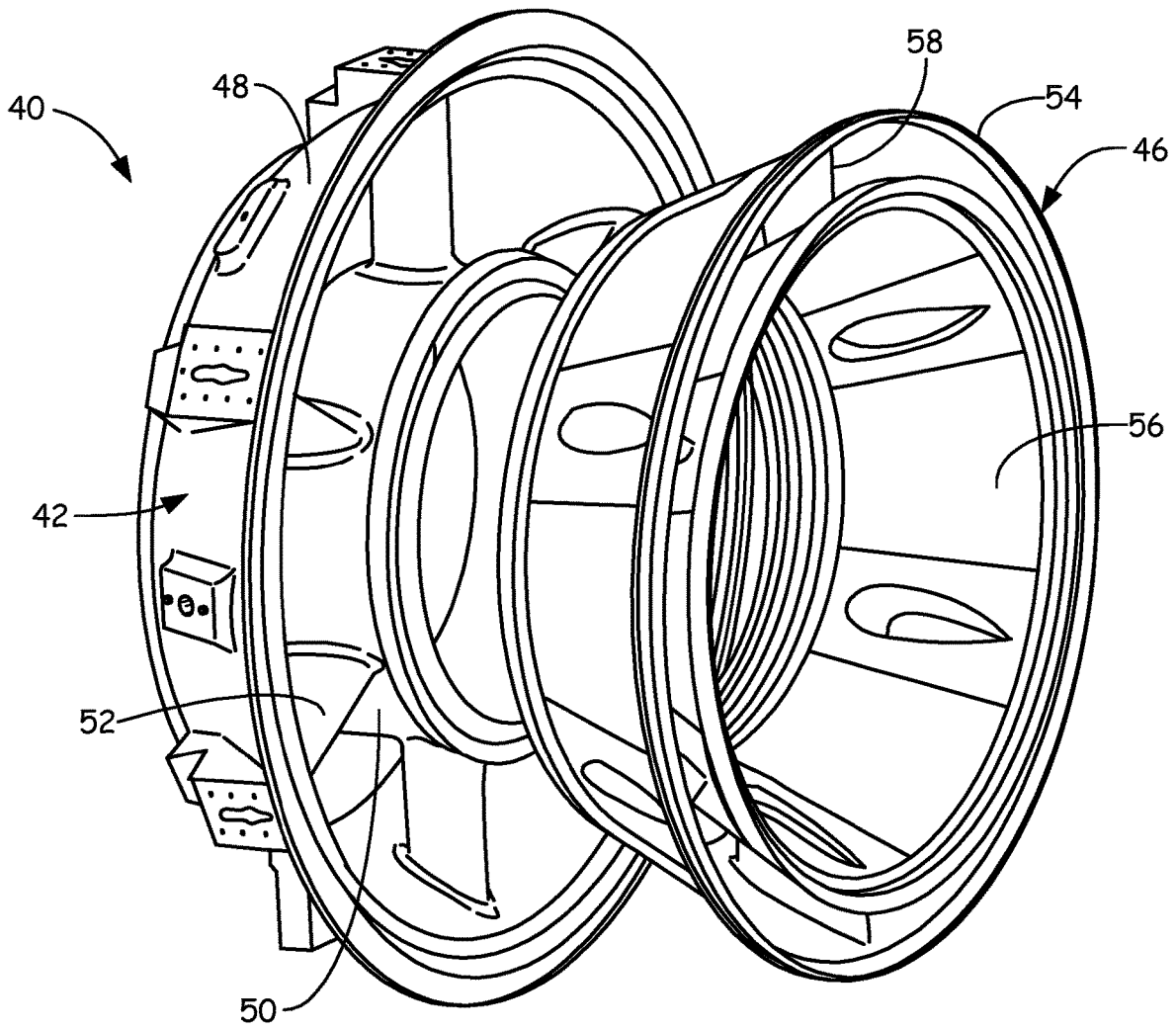
FIG. 2 is exploded view of an assembly including a frame and a fairing.

FIG. 2 shows an exploded view of assembly 40 with frame 42 and fairing 46. Embodiments of the heat shield are not shown in FIG. 2. Assembly 40 includes frame 42, heat shields, and fairing 46. Frame 42 includes outer radial casing 48, inner radial casing 50, and struts 52. Fairing 46 includes outer radial platform 54, inner radial platform 56, and strut liners 58.

Frame 42 comprises a stator component of gas turbine engine 10 (FIG. 1) and can form portions of compressor sections 16 and 18 or turbine sections 22 and 24. Fairing 46 is disposed within frame 42 and fairing 46 is connected to the frame 42 when assembled. Fairing 46 is disposed within the frame 42 to form the main gas flow path for a portion of gas turbine engine 10.

As illustrated in FIG. 2, outer radial casing 48 of frame 42 is conically shaped and forms a portion of the casing of gas turbine engine 10 (FIG. 1), for example, in low pressure turbine section 24. Inner radial casing 50 is disposed generally radially inward of outer radial casing 48 and is connected thereto by struts 52.

Fairing 46 is adapted to be disposed within frame 42 between outer radial casing 48 and inner radial casing 50. Outer radial platform 54 of fairing 46 has a generally conical shape. Similarly, inner radial platform 56 has a generally conical shape. Inner radial platform 56 is spaced from outer radial platform 54 by strut liners 58. Strut liners 58 are adapted to be disposed around struts 52 of frame 42.

Figure 3A:
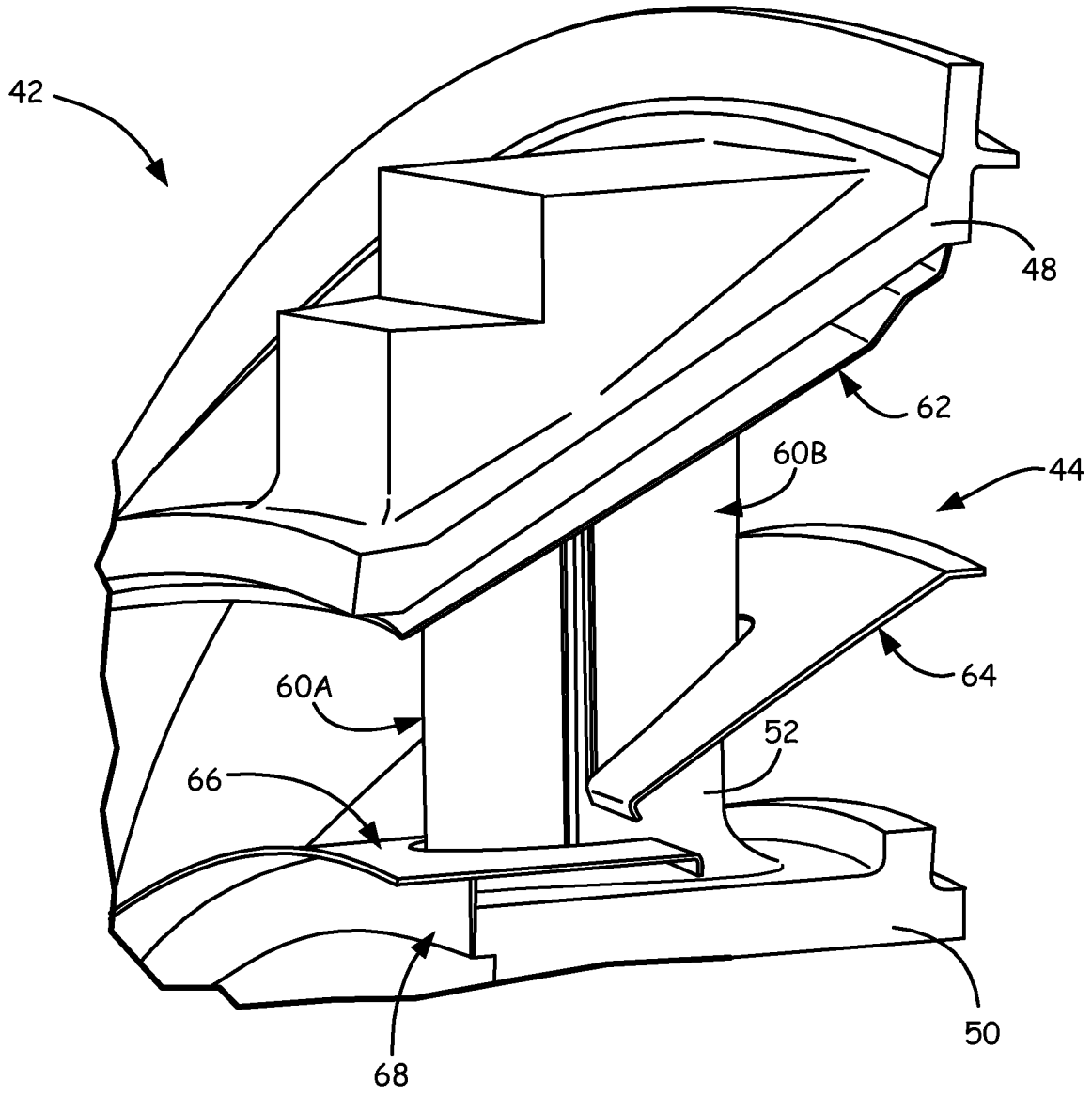
FIG. 3A is a perspective view of a portion of the frame with one embodiment of the multi-piece heat shield assembly disposed therein.
Figure 3B:
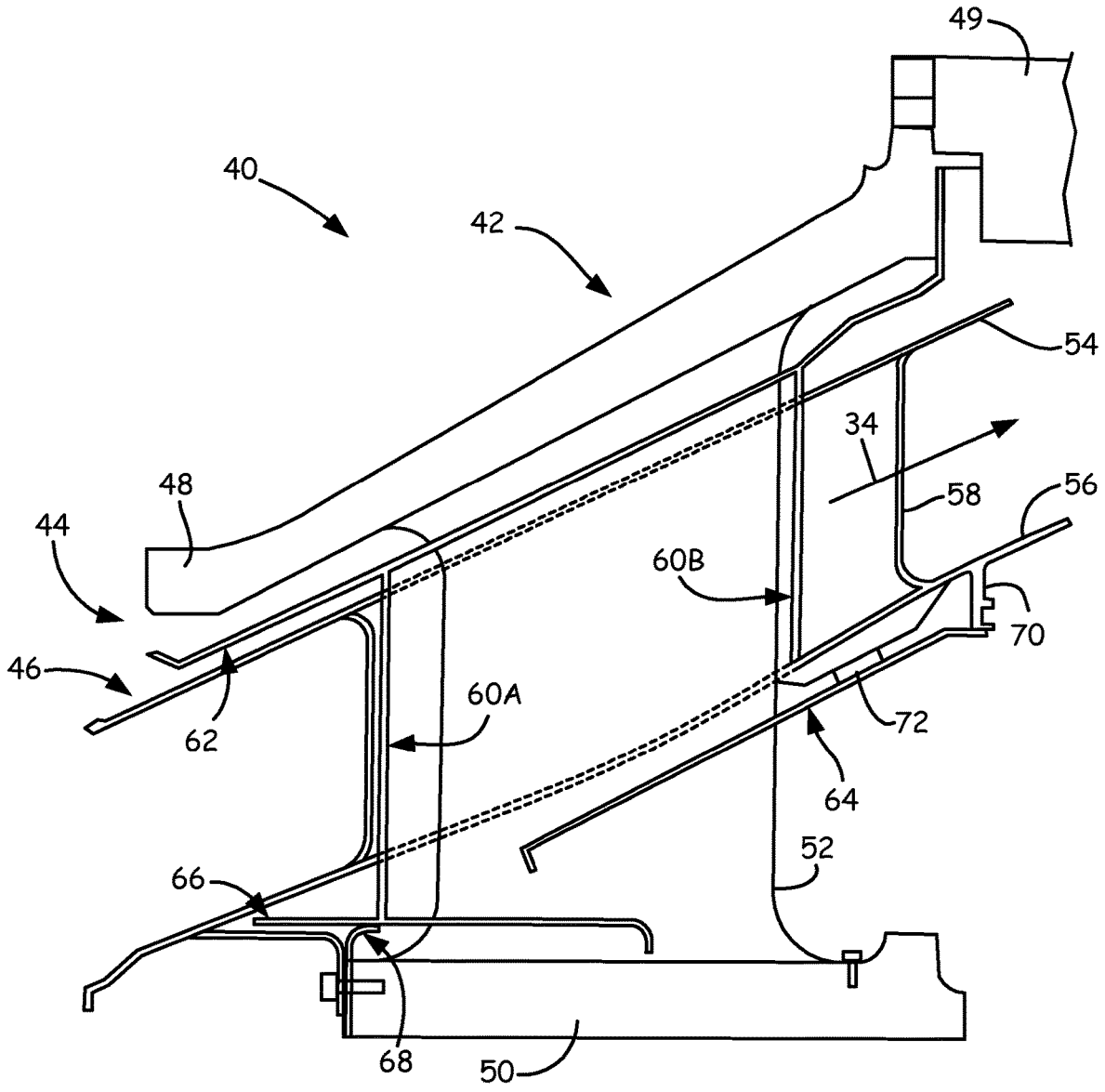
FIG. 3B is a cross sectional view of the frame, the fairing, and the multi-piece heat shield assembly of FIG. 3A.

FIG. 3A illustrates a portion of frame 42 and one embodiment of heat shield assembly 44. Fairing 46 (FIGS. 2 and 3B) is not shown in FIG. 3A. FIG. 3B shows assembly 40 with frame 42, fairing 46, and heat shield assembly 44. Assembly 40 of FIG. 3B includes frame 42, heat shield assembly 44, and fairing 46. Frame 42 includes outer radial casing 48, inner radial casing 50, and struts 52. Fairing 46 includes outer radial platform 54, inner radial platform 56, and strut liners 58. Heat shield assembly 44 includes strut shields 60A and 60B, outer radial heat shield 62, aft heat shield 64, forward heat shield 66, and flange 68.

As illustrated in FIGS. 3A and 3B, outer radial casing 48 of frame 42 is conically shaped and abuts and is connected to second outer radial casing 49 of another module of gas turbine engine 10. Inner radial casing 50 is disposed generally radially inward of outer radial casing 48 and is connected thereto by struts 52 (only one is shown in FIGS. 3A and 3B).

Fairing 46 is adapted to be disposed within frame 42 between outer radial casing 48 and inner radial casing 50. Strut liners 58 are adapted to be disposed around struts 52 of frame 42 as well as strut shields 60A and 60B of heat shield 44 when fairing 46 is assembled on frame 42 as illustrated in FIG. 3B. Outer radial platform 54, inner radial platform 56, and strut liners 58, form the main gas flow path, which directs combustion gases 34 through the portion of gas turbine engine illustrated in FIG. 3B.

Heat shield 44 is disposed between frame 42 and fairing 46 in FIG. 3B to block line-of-sight from fairing 46 to frame 42. As used therein, block line-of-sight means that no portion of frame 42 is exposed to faring 46 travelling axially from a forward end of frame 42 to an aft end. Thus, to block line-of-sight a part of heat shield assembly 44 is interposed between frame 42 and fairing 46. In one embodiment, heat shield assembly 44 is comprised of a nickel alloy sheet metal. As illustrated in FIGS. 3A and 3B, heat shield assembly 44 is comprised of separate components and/or subassemblies of heat shields including strut shields 60A and 60B, outer radial shield 62, aft shield 64, forward shield 66, and flange 68.

Strut shields 60A and 60B extend about struts 52 and are disposed between strut liner 58 and struts 52. Each strut shield 60A and 60B extends generally radially and is connected to outer radial shield 62. Outer radial shield 62 is disposed between outer radial casing 48 and outer radial platform 54. Strut shields 60A and 60B can initially be divided (as illustrated in FIG. 3A) for installation around struts 52. After installation, outer radial shield 62 and strut shields 60A and 60B can be connected together by welding, brazing, riveting or other means.

Aft shield 64 has a conical shape when assembled and is spaced from but generally extends along inner radial platform 56. In the embodiment of FIG. 3B, inner radial platform 56 includes connection feature 72 such as an embossment, rib, rivet, bolt or weld that mounts aft shield 64 to inner radial platform 56. Additionally, aft shield 64 extends aft to interface with and connect to rib 70 of inner radial platform 56 in the embodiment of FIG. 3B. Aft shield 64 extends forward to overlap with and is spaced radially from forward shield 66. Forward shield 66 is connected to inner radial casing 50 by flange 68 and bolts. In other embodiments, flange 68 can be connected to inner radial casing 50 by welding, brazing, riveting, or another type of connection. Forward shield 66 is spaced from but extends along a forward portion of inner radial casing 50 and is disposed radially inward of aft shield 64.

Together, forward shield 66 and aft shield 64 block line-of-sight from fairing 46 to inner radial casing 50. This reduces or blocks radiant heat transfer from fairing 46 to inner radial casing 50. Additionally, spacing forward shield 66 from aft shield 64 so that the components overlap axially but do not make contact allows for ease of installation and removal of heat shield assembly 44 from frame 42. For example, during assembly forward shield 66 can be inserted in and connected to inner radial casing 50, and then fairing 46 and aft shield 64 can be insert into frame 42 and connected without having forward shield 66 interfere with the assembly process.

In the embodiment shown in FIGS. 3A and 3B, strut shield 60A and forward shield 66 are connected to one another by welding, riveting, brazing, or other means. Similarly, outer radial shield 62 and strut shields 60A and 60B are connected by welding, riveting, brazing, or other means. In other embodiments, strut shields 60A and 60B can comprise single components, can be axially or otherwise segmented, or can comprise subassemblies of several components. Similarly, in other embodiments, forward shield 66 and aft shield 64 can comprise a single component that is formed by machining, rolling, stamping, curling, punching, and/or another method of fabrication. In other embodiments, forward shield 66 and aft shield 64 can comprise single components, can be axially or otherwise segmented and attached, or can comprise subassemblies of several components.

Figure 4A:
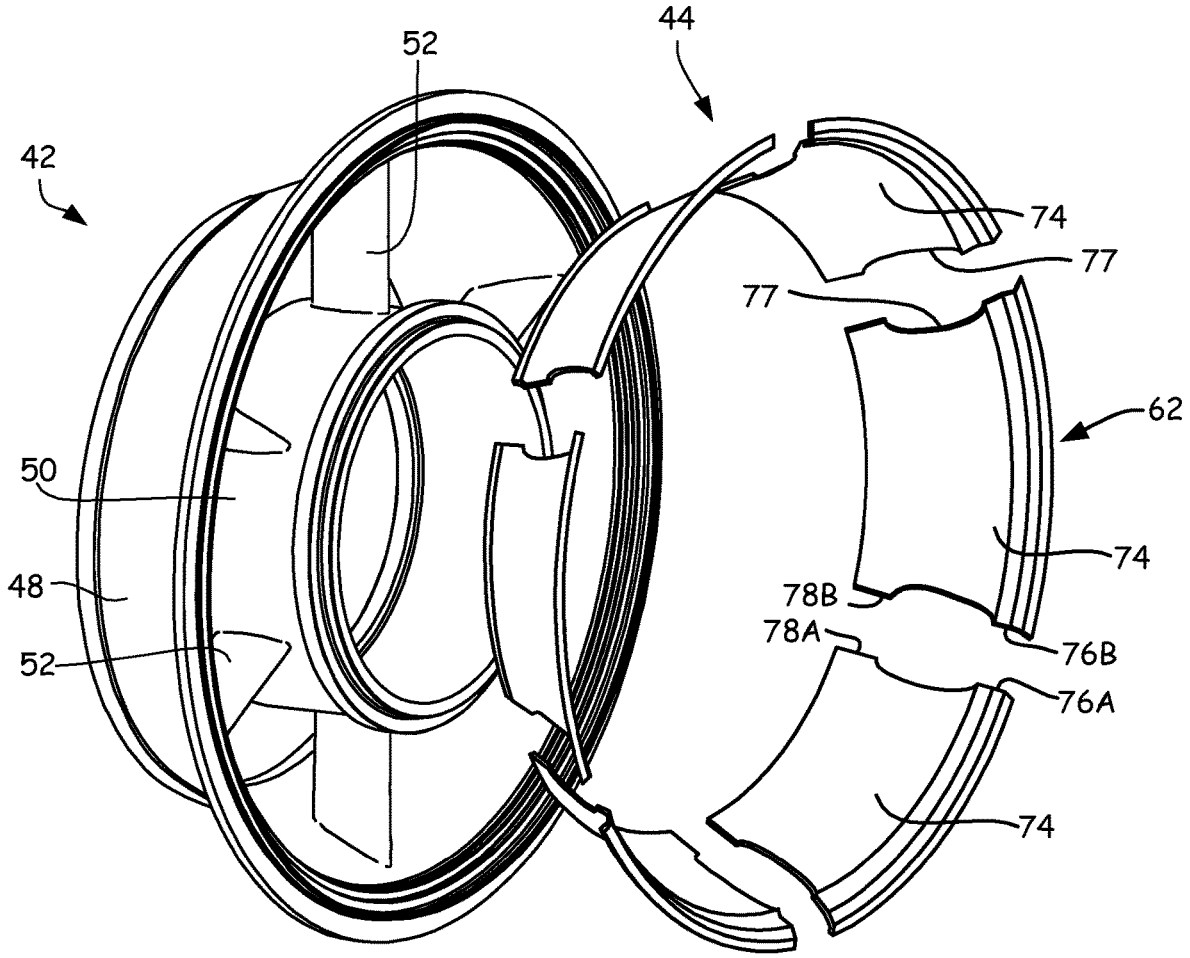
FIG. 4A illustrates segments of an outer radial shield of the multi-piece heat shield assembly of FIG. 3A being inserted into the frame.

FIG. 4A shows one embodiment of outer radial shield 62 with separate segments 74 prior to installation in frame 42. In the embodiment of outer radial shield 62 shown in FIG. 4A, segments 74 are individually inserted into frame 42 between struts 52 and between inner radial casing 50 and outer radial casing 48. Segments 74 are adapted with notches 77 therein. Notches 77 are adapted to receive half of each strut 52. Circumferential edges 76A and 78A of segments 74 are adapted to interface and abut circumferential edges 76B and 78B of neighboring segment 74. Edges 76A and 76B can then be welded, brazed, riveted, or otherwise joined together to form full ring of outer radial casing 62. Thus, struts 52 are enclosed by notches 77 in neighboring segments 74.

Figure 4B:
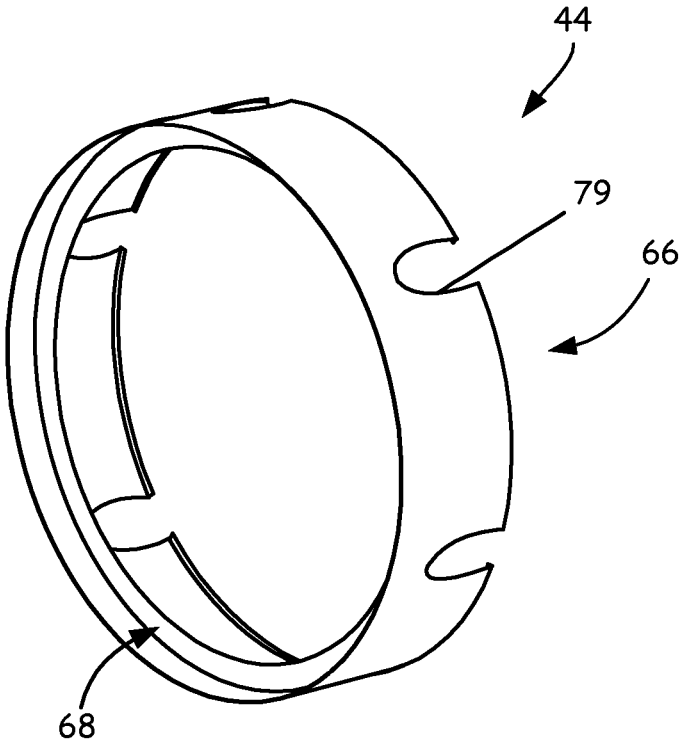
FIG. 4B is a perspective view of one embodiment of a forward heat shield of the multi-piece heat shield assembly of FIG. 3A.

FIG. 4B shows a perspective view of one embodiment of forward shield 66. Forward shield 66 comprises a full annular ring with notches 79 therein to receive the inner radial portion of struts 52. Flange 68 extends generally radially from forward shield 66 and is adapted to interface with inner radial casing as shown in FIG. 3B.

Figure 4C:
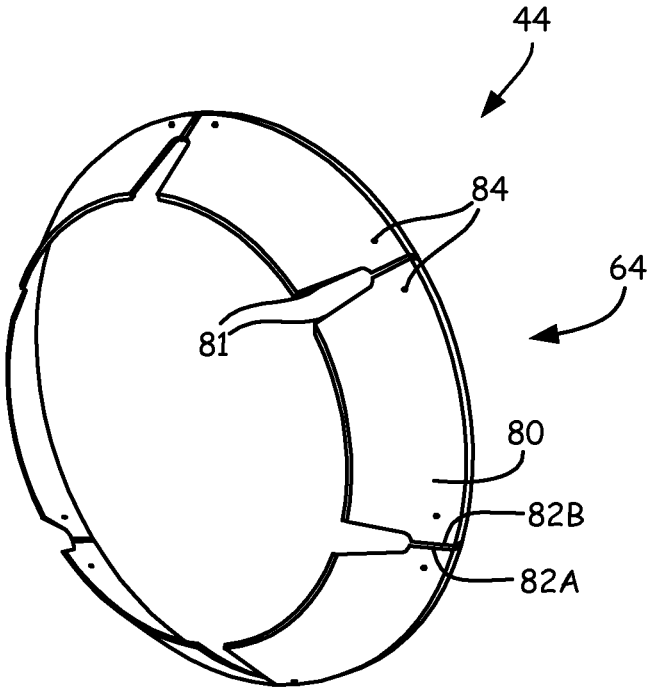
FIG. 4C is a perspective view of one embodiment of an aft heat shield of the multi-piece heat shield assembly of FIG. 3A.

FIG. 4C shows a perspective view of one embodiment of aft shield 64. Aft shield 64 is comprised of segments 80 that are arranged adjacent one another. Each segment 80 includes notches 81 adapted to receive an aft portion of each strut 52. In the embodiment shown, first edge 82B of segment 80 is spaced from and does not abut second edge 82A of neighboring segment 80. Each segment 80 forms apertures 84 that are adapted to receive bolts or fasteners (not shown) that extend through connection feature 72 (FIG. 3B) in fairing 46.

Figure 5:
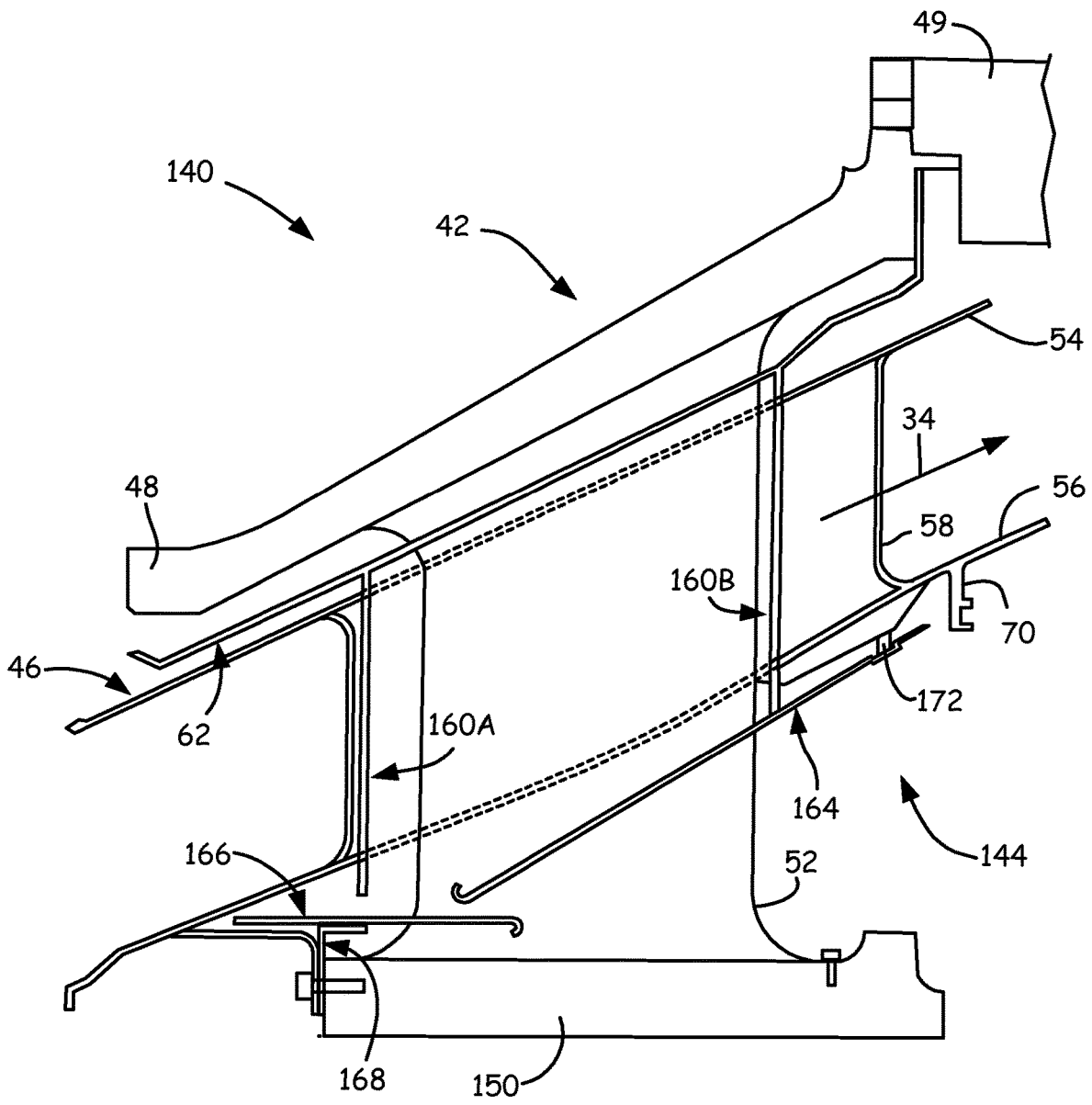
FIG. 5 is a cross sectional view of the frame, the fairing, and another embodiment of a multi-piece heat shield assembly.

FIG. 5 shows another embodiment of assembly 140 with frame 42, fairing 46, and heat shield 144. Components of frame 42 and fairing 46 are unchanged in FIG. 3B and FIG. 5. In the embodiment of FIG. 5, outer radial heat shield 62 is the same as the embodiment of FIG. 3B. However, the embodiments of strut shields 160A and 160B, aft shield 164, and forward shield 166 differ in the embodiment of FIG. 5.

Strut shields 160A and 160B extend about struts 52 and are disposed between strut liner 58 and struts 52. Each strut shield 160A and 160B extends generally radially and is connected to outer radial shield 62. Strut shield 160A does not contact forward shield 166. Strut shield 160B is connected to aft shield 164 along an inner radial portion thereof.

Aft shield 164 has a conical shape when assembled and is spaced from but generally extends along inner radial platform 56. In the embodiment of FIG. 5, inner radial platform 56 includes connection feature 172 such as an embossment, rib, rivet, bolt or weld that mounts aft shield 164 to inner radial platform 56. Aft shield 164 is spaced from and does not connect to rib 70 of inner radial platform 56. Aft shield 164 extends forward to overlap and is spaced radially from forward shield 166. Forward shield 166 is connected to inner radial casing 50 by flange 168 and bolts. In other embodiments, flange 168 can be connected to inner radial casing 50 by welding, brazing, riveting, or another type of connection. Forward shield 166 is spaced from but extends along a forward portion of inner radial casing 50 and is disposed radially inward of aft shield 164.

Together, forward shield 166 and aft shield 164 block all line-of-sight from fairing 46 to inner radial casing 50. This reduces or blocks radiant heat transfer from fairing 46 to inner radial casing 50. Additionally, spacing forward shield 166 from aft shield 164 so that the components overlap axially but do not make contact due to radial spacing allows for ease of installation and removal of heat shield assembly 144 from frame 42. For example, during assembly forward shield 166 can be inserted in and connected to inner radial casing 50, and then fairing 46 and aft shield 164 can be insert into frame 42 and connected without having forward shield 166 interfere with the assembly process.

Figure 6:
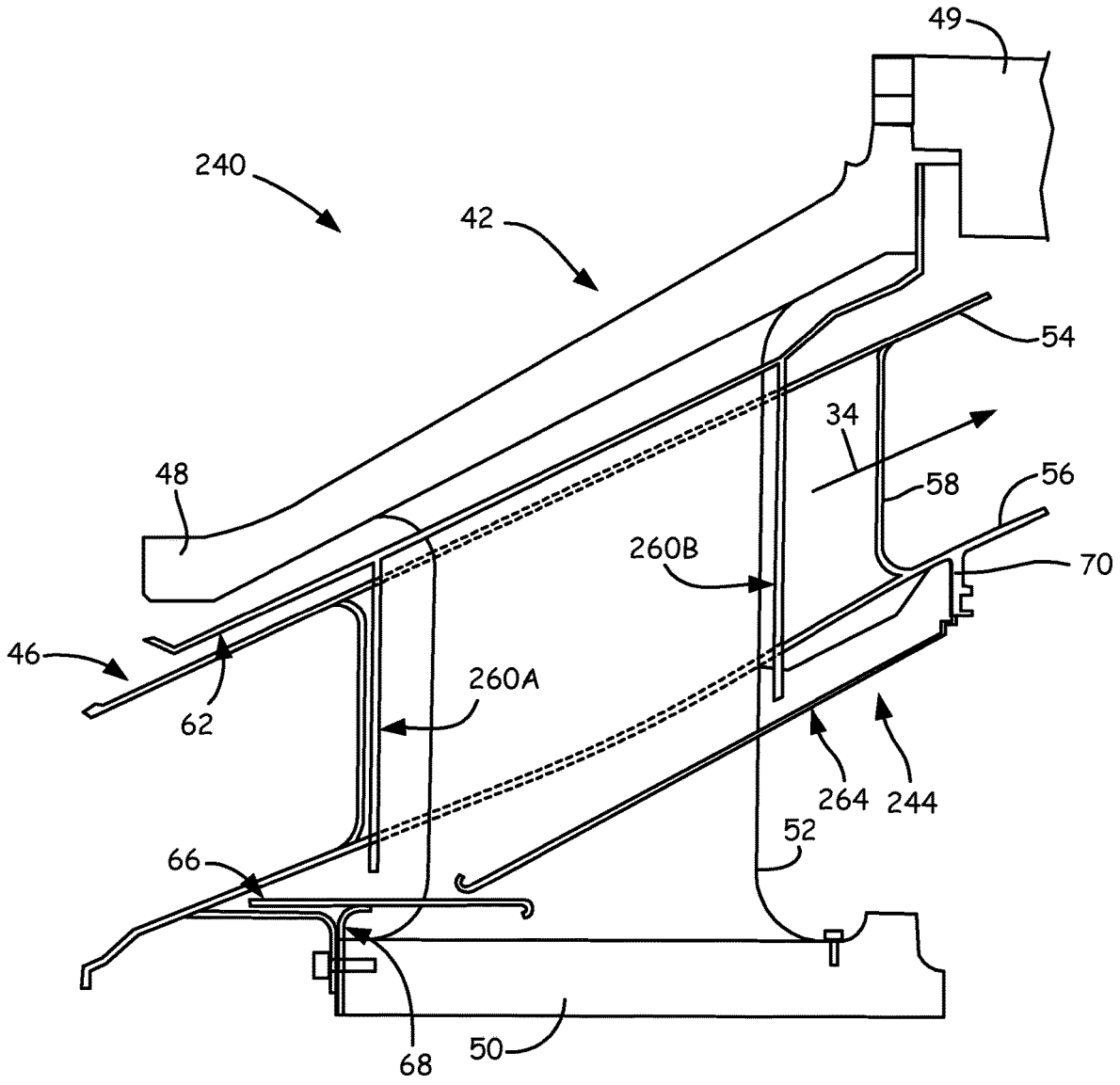
FIG. 6 is a cross-sectional view of the frame, the fairing, and yet another embodiment of a multi-piece heat shield assembly.

FIG. 6 shows another embodiment of assembly 240 with frame 42, fairing 46, and heat shield 244. Components of frame 42 and fairing 46 are unchanged in FIG. 3B and FIG. 6. In the embodiment of FIG. 6, outer radial heat shield 62, forward heat shield 66, and flange 68 are the same as the embodiment of FIG. 3B. However, the embodiments of strut shields 260A and 260B, and aft shield 264 differ in the embodiment of FIG. 6.

Strut shields 260A and 260B extend about struts 52 and are disposed between strut liner 58 and struts 52. Each strut shield 260A and 260B extends generally radially and is connected to outer radial shield 62. Strut shield 260A is spaced from and does not contact forward shield 66. Strut shield 260B is spaced from and does not contact aft shield 264.

Aft shield 264 has a conical shape when assembled and is spaced from but generally extends along inner radial platform 56. In the embodiment of FIG. 6, inner radial platform 56 does not include connection feature (FIG. 3B and FIG. 5). Aft shield 264 is connected to rib 70 of inner radial platform 56 by brazing, welding, riveting or other joining techniques. Aft shield 264 extends forward to overlap and is spaced radially from forward shield 66. Forward shield 66 is connected to inner radial casing 50 by flange 68 and bolts. In other embodiments, flange 68 can be connected to inner radial casing 50 by welding, brazing, riveting, or another type of connection. Forward shield 66 is spaced from but extends along a forward portion of inner radial casing 50.

Together, forward shield 66 and aft shield 264 block all line-of-sight from fairing 46 to inner radial casing 50. This reduces or blocks radiant heat transfer from fairing 46 to inner radial casing 50. Additionally, spacing forward shield 66 from aft shield 264 so that the components overlap axially but do not make contact due to radial spacing allows for ease of installation and removal of heat shield assembly 244 from frame 42. For example, during assembly forward shield 66 can be inserted in and connected to inner radial casing 50, and then fairing 46 and aft shield 264 can be insert into frame 42 and connected without having forward shield 66 interfere with the assembly process.

Figure 7:
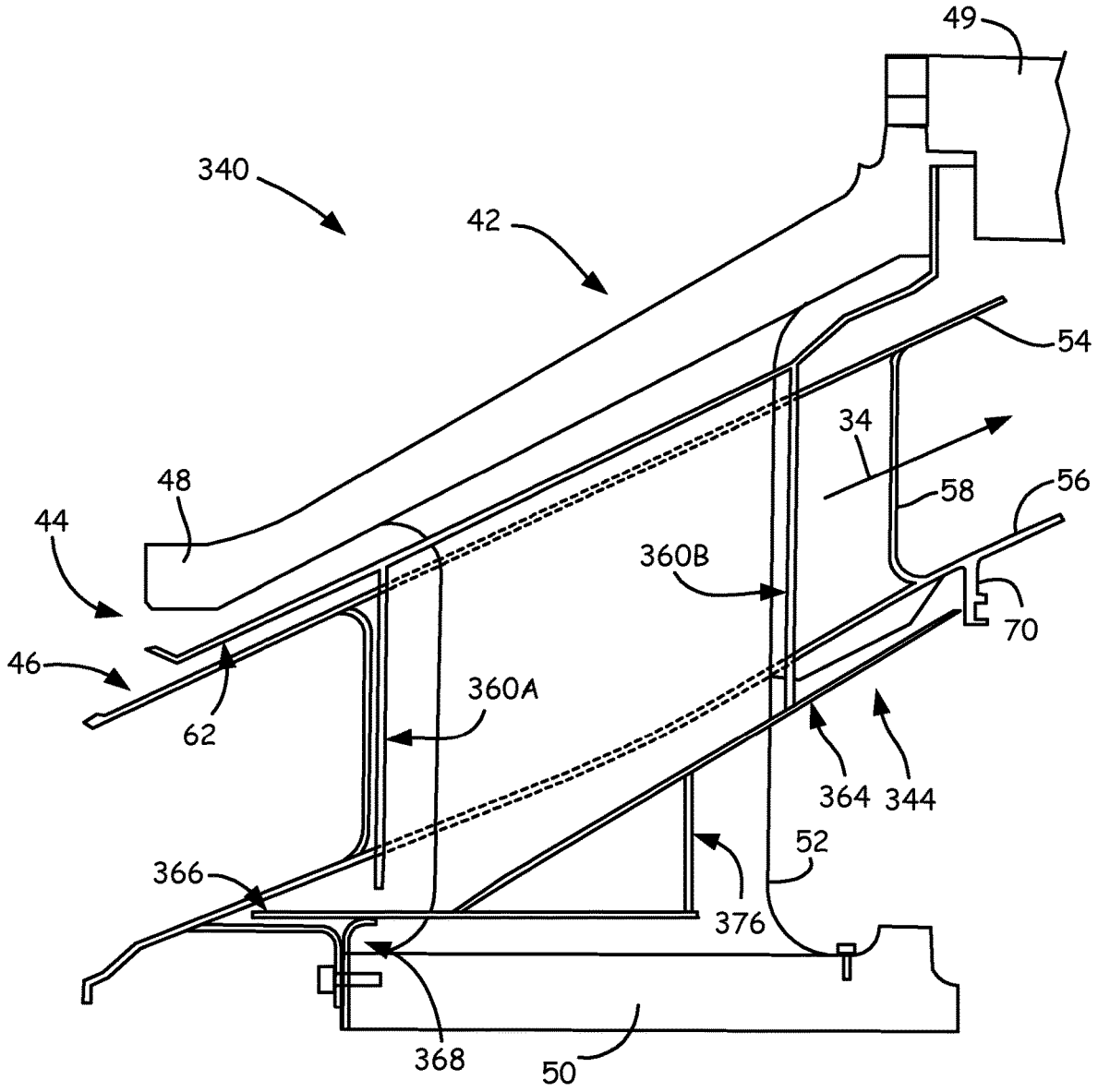
FIG. 7 is a cross-sectional view of the frame, the fairing, and another embodiment of a multi-piece heat shield assembly.

FIG. 7 shows another embodiment of assembly 340 with frame 42, fairing 46, and heat shield 344. Components of frame 42 and fairing 46 are unchanged in FIG. 3B and FIG. 7. In the embodiment of FIG. 7, outer radial heat shield 62 is the same as the embodiment of FIG. 3B. However, the embodiments of strut shields 360A and 360B, aft shield 364, and forward shield 366 differ in the embodiment of FIG. 7.

Strut shields 360A and 360B extend about struts 52 and are disposed between strut liner 58 and struts 52. Each strut shield 360A and 360B extends generally radially and is connected to outer radial shield 62. Strut shield 360A does not contact forward shield 366. Strut shield 360B is connected to aft shield 364 along an inner radial portion thereof.

Aft shield 364 has a conical shape when assembled and is spaced from but generally extends along inner radial platform 56. Aft shield 364 is supported by member 376. Member 376 extends generally radially from and is connected to forward shield 366. Member 376 extends to abut and connect with a middle portion of aft shield 364. Aft shield 364 additionally extends to connect with forward shield 366 along a forward end thereof. In the embodiment of FIG. 7, aft shield 364 is spaced from and does not connect to rib 70 nor any other portion of inner radial platform 56.

Forward shield 366 is connected to inner radial casing 50 by flange 368 and bolts. In other embodiments, flange 368 can be connected to inner radial casing 50 by welding, brazing, riveting, or another type of connection. Forward shield 366 is spaced from but extends along a forward portion of inner radial casing 50.

Together, forward shield 366 and aft shield 364 block all line-of-sight from fairing 46 to inner radial casing 50. This reduces or blocks radiant heat transfer from fairing 46 to inner radial casing 50. Additionally, the arrangement of forward shield 366 and aft shield 364 disclosed allows for easy installation and removal of heat shield assembly 344 from frame 42. For example, during assembly forward shield 366 can be inserted in and connected to inner radial casing 50, and then fairing 46 and aft shield 364 can be inserted into frame 42 and connected. Once inserted, aft shield 364 can be welded or otherwise attached to forward shield 366 at a forward end. Member 376 can then be inserted and welded or otherwise attached to both aft shield 364 and forward shield 366.

Figure 8:
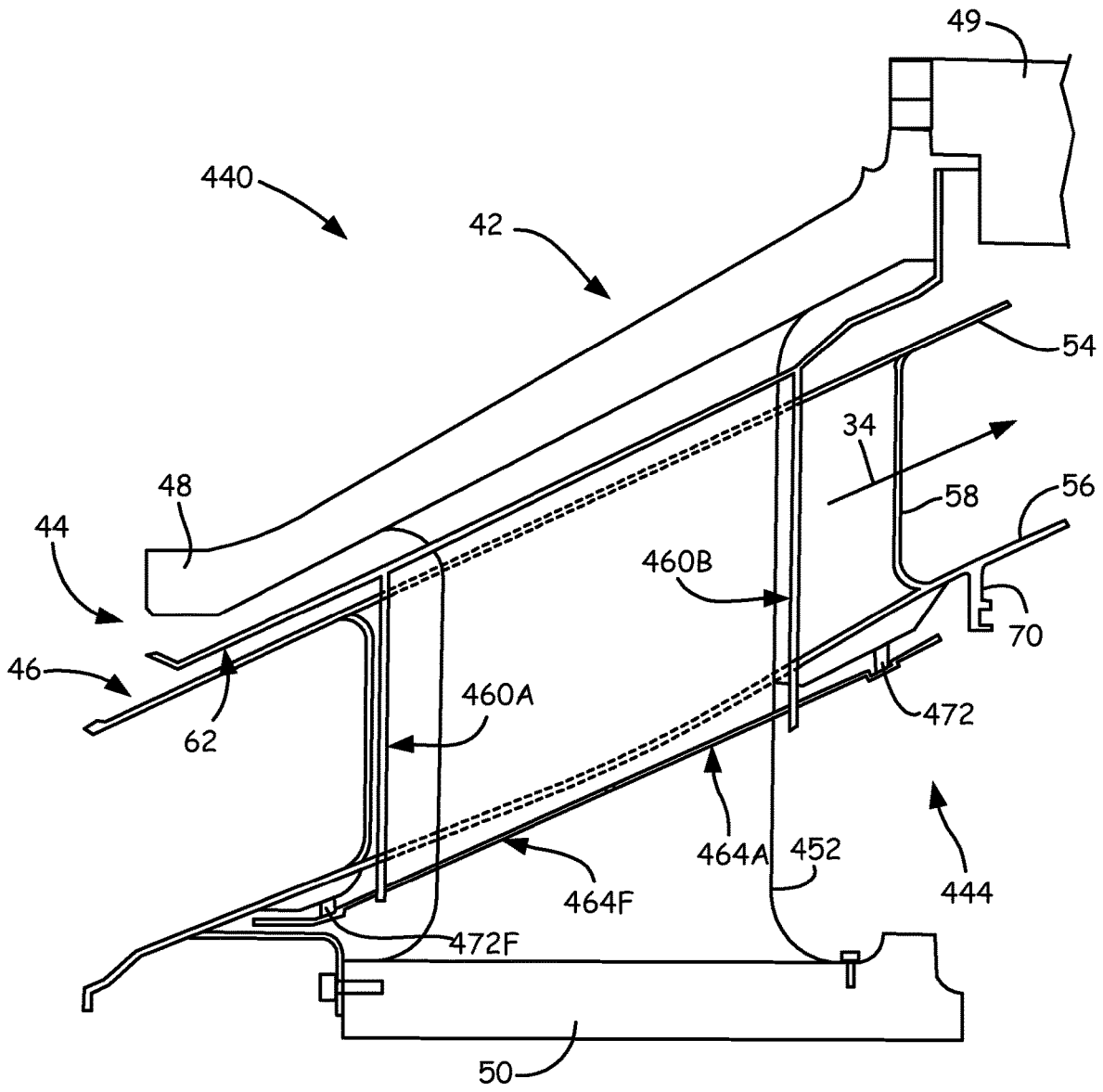
FIG. 8 is a cross-sectional view of the frame, the fairing, and another embodiment of a multi-piece heat shield assembly.

FIG. 8 shows another embodiment of assembly 440 with frame 42, fairing 46, and heat shield 444. Components of frame 42 and fairing 46 are unchanged in FIG. 3B and FIG. 8. In the embodiment of FIG. 8, outer radial heat shield 62 is the same as the embodiment of FIG. 3B. However, the embodiments of strut shields 160A and 160B, shield 464F and 464A differ in the embodiment of FIG. 8. Forward shield 66 of the embodiment of FIG. 3B has been eliminated in the embodiment of FIG. 8.

Strut shields 460A and 460B extend about struts 52 and are disposed between strut liner 58 and struts 52. Each strut shield 460A and 460B extends generally radially and is connected to outer radial shield 62. Both strut shields 460A and 460B are connected to and extend past shield 464F and 464A, respectively. This is accomplished by slots in shield 464F and 464A that receive tabs in strut shield 460A and 460B in one embodiment.

Shields 464A and 464F have a conical shape when assembled and are spaced from but generally extend along inner radial platform 56. In the embodiment of FIG. 8, inner radial platform 56 includes aft connection feature 472 such as an embossment, rib, rivet, bolt or weld that mounts shield 464A to inner radial platform 56. Similarly, inner radial platform 56 includes forward connection feature 472F such as an embossment, rib, rivet, bolt or weld that mounts shield 464F to inner radial platform 56. Shield 464A is spaced from and does not connect to rib 70 of inner radial platform 56. As will be discussed subsequently, shield 464A and shield 464F are intermittently connected around their circumference. As discussed previously, as shields 464A and 464F are extended along substantially the entire length between fairing 46 and inner radial casing 50, forward shield 66 (FIG. 3B) is eliminated from assembly 440. Together, shield 464F and shield 464A block all line-of-sight from fairing 46 to inner radial casing 50. This reduces or blocks radiant heat transfer from fairing 46 to inner radial casing 50.

Figure 9A:
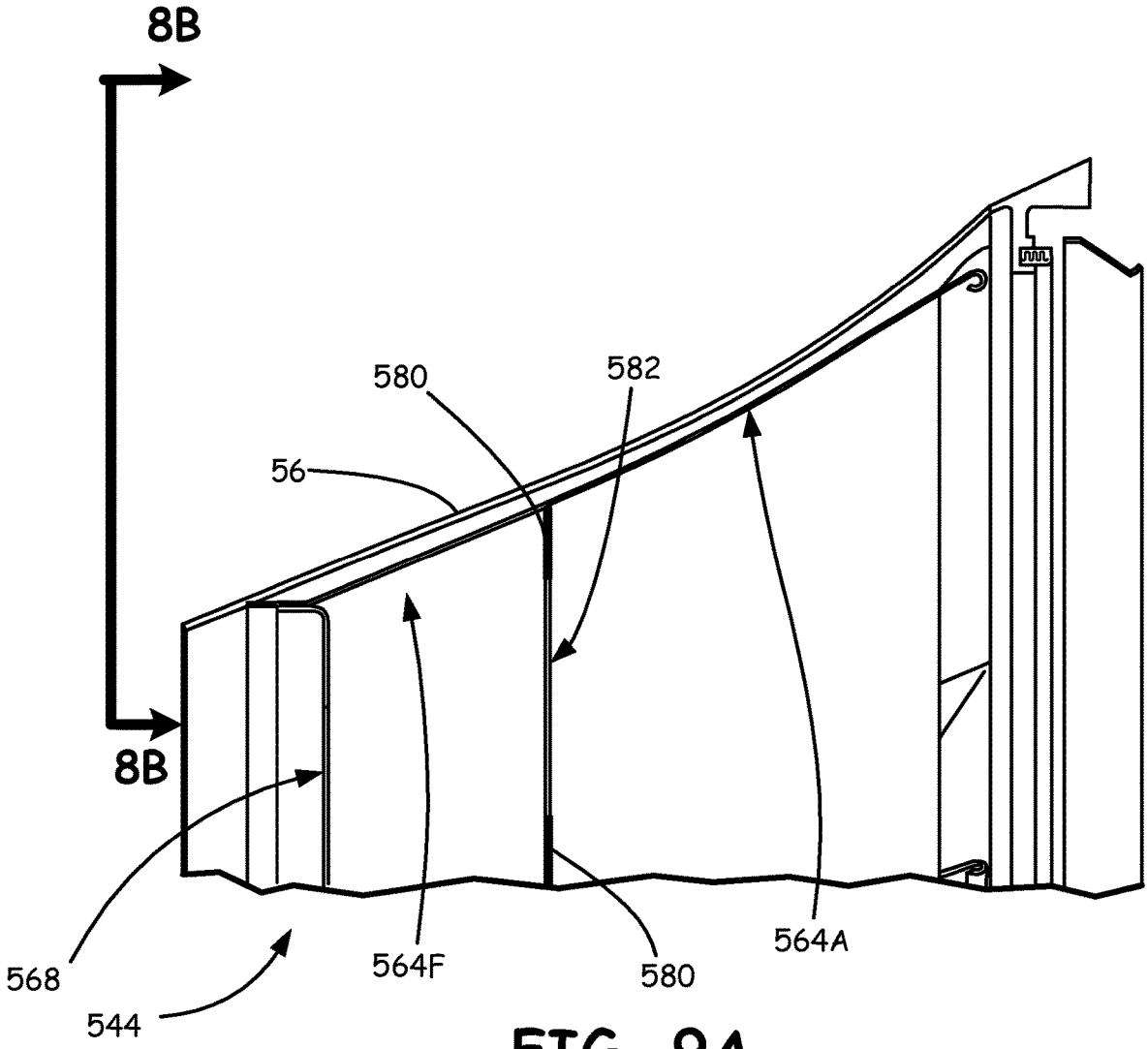
FIG. 9A is a cross-sectional view of another embodiment of a multi-piece heat shield assembly illustrating forward and aft heat shields that are intermittently circumferentially joined together.
Figure 9B:
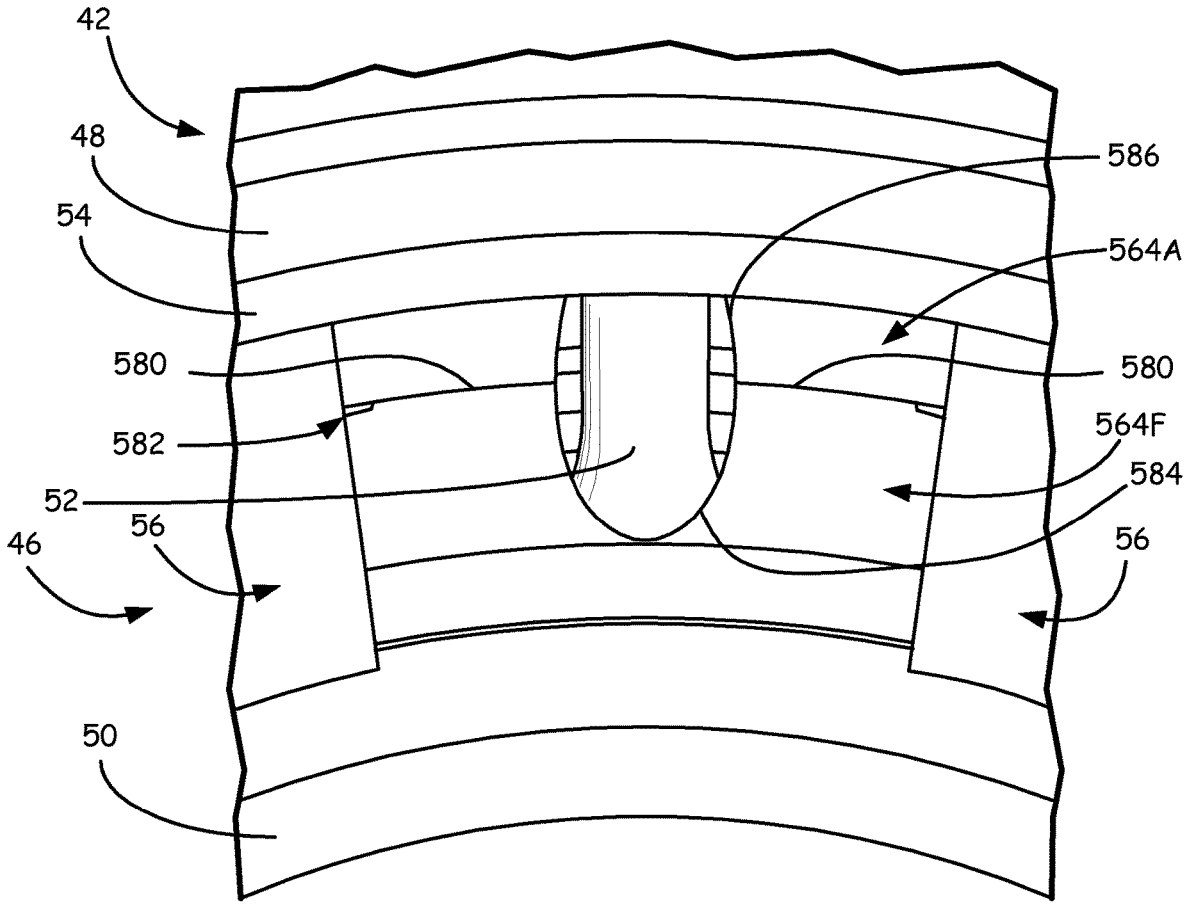
FIG. 9B is a perspective view of the frame, fairing and multi-piece heat shield assembly of FIG. 9A illustrating the forward and aft heat shields intermittently circumferentially joined together.

FIG. 9A shows a perspective view of a section of another embodiment of heat shield 544 and inner radial platform 56. Frame 42 has been removed in FIG. 9A (but is shown in FIG. 9B) to illustrate the welding and gap between shield 564F and shield 564A. Similar to the embodiment of heat shield shown in FIG. 8, the embodiment shown in FIG. 9A includes shield 564F arranged forward of shield 564A. As shown in FIG. 9A, shield 564F is intermittently circumferentially connected by welds 580 to shield 564A. Similarly, shield 564F is intermittently spaced from shield 564A by gap 582. Shield 564F and shield 564A extend adjacent inner platform 56 from a forward section to an aft section. Shield 564F is connected to flange 568, which supports shield 564F from inner radial casing 50 (FIGS. 2-8). Shield 564A is supported from fairing 46 by connection features (not shown, FIGS. 3B, 5, and 8). In other embodiments, shield 564F and 564A may utilize other methods of joining rather than welding, for example, riveting or brazing. In yet other embodiments, shield 564F and 564A may comprise a single piece, be continuously circumferentially connected, or be entirely separated by gap 582 for the entire circumference of heat shield 544.

FIG. 9B illustrates a portion of frame 42 and fairing 46 with a segment of inner radial platform 56 removed to illustrate shield 564F and 564A, intermittent welds 580, and gaps 582. As shown in FIG. 9B, the portion of frame 42 illustrated includes forward (upstream with respect to the direction of gas flow) portions of outer radial casing 48 and inner radial casing 50. Outer radial platform 54 is spaced adjacent outer radial casing 48. Inner radial platform 56 has a segment removed to illustrate shield 564F and 564A, intermittent welds 580, and gaps 582. In particular, shield 564F arranged forward of shield 564A. Shield 564F is intermittently circumferentially connected by welds 580 to shield 564A. Shield 564F is intermittently spaced from shield 564A by gap 582. Shield 564F includes notches 584 that extend around a forward portion of strut 52 (strut liner 58 is removed in FIG. 9B) and shield 564A includes notches 586 that extend around an aft portion of strut 52.

This application discloses a multi-piece heat shield that is easily assembled within the frame. The multiple pieces of the heat shield overlap with one another or are joined together to eliminate line-of-sight from the fairings. The heat shield design blocks or reduces radiation heating from the frame, including the inner casing and outer casing, and therefore, allows less expensive materials (steel) to be used for those components.

Discussion of Possible Embodiments

The following are non-exclusive descriptions of possible embodiments of the present invention.

An assembly for a gas turbine engine includes a first casing, a fairing, and a multi-piece heat shield assembly. The fairing is disposed adjacent the first casing. The multi-piece heat shield assembly includes a first shield mounted to the first casing and extending between the first casing and the fairing, and a second shield mounted to the fairing and extending between the fairing and the first casing.

The assembly of the preceding paragraph can optionally include, additionally and/or alternatively, any one or more of the following features, configurations and/or additional components:

struts extending from the first casing and supporting a second casing;

the first shield and the second shield include apertures adapted to receive the struts;

a third shield extending between the second casing and the fairing, the third shield includes apertures adapted to receive the struts;

the third shield is comprised of a plurality of connected arcuate segments.

a fourth shield disposed about the struts and extending between the struts and the fairing;

the first shield includes a flange adapted to interface with the casing;

the first shield includes a cylindrical portion that is disposed within the casing;

the second shield is attached to a rib of the fairing;

the second shield is attached to an inner radial platform of the fairing;

second shield is spaced from and extends across the first shield such that a portion of the second shield is disposed between the fairing and a portion of the first shield;

the first shield is connected to the second shield; and the first shield is intermittently circumferentially connected to the second shield.

A gas turbine engine includes a frame, an annularly shaped fairing, and a multi-piece heat shield. The frame has an inner casing, an outer casing, and struts that extend between the inner casing and outer casing. The annularly shaped fairing is disposed adjacent the frame between the inner casing and the outer casing. The multi-piece heat shield is connected to the frame and the fairing. The multi-piece heat shield includes a first shield that extends between the inner casing and the fairing, a second shield that is spaced from and extends across a portion of the first shield and extends between the fairing and the inner casing, and a third shield that extends between the outer radial casing and the fairing.

The gas turbine engine of the preceding paragraph can optionally include, additionally and/or alternatively, any one or more of the following features, configurations and/or additional components:

the first shield, the second shield, and the third shield include apertures adapted to receive the struts; and a fourth shield disposed about the struts and extending between the struts and the fairing.

A method includes disposing the plurality of heat shield segments adjacent a casing and between a plurality of struts that extend from the casing, connecting the segments to the casing, and attaching the segments together to form a heat shield having a first portion positioned adjacent the casing and a second portion extending away from the casing.

The method of the preceding paragraph can optionally include, additionally and/or alternatively, any one or more of the following features, configurations and/or additional components:

attaching the segments of the third shield together to form a generally conically shaped heat shield;

joining the first shield to the second shield; and disposing the second shield such that a portion of the second shield is spaced from and extends across a portion of the first shield.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An assembly for a gas turbine engine, comprising:

a first casing;

a second casing;

a plurality of struts extending from the first casing and supporting the second casing;

a fairing between the first casing and the second casing and disposed around each of the plurality of struts;

a multi-piece heat shield assembly comprising:

a first shield extending between the first casing and the fairing;

a second shield extending between the first casing and the fairing;

a third shield extending between the second casing and the fairing; and a plurality of fourth shields connected to the third shield, each fourth shield extending radially from the third shield and between a forward-facing side of each strut and the fairing towards the first shield; and a plurality of fifth shields connected to the third shield, each fifth shield extending radially from the third shield and between an aft-facing side of each strut and the fairing to connect the second shield to the third shield;

wherein each of the first shield, the second shield, and the third shield includes a notch adapted to receive one of the struts.

2. The assembly of claim 1, wherein each of the plurality of fourth shields extends from a first end connected to the third shield to a second end radially spaced from the first shield.

3. The assembly of claim 2, wherein the second shield is radially spaced from the first shield and extends from the fairing to overlap at least a portion of the first shield.

4. The assembly of claim 1, wherein the first shield is mounted to the first casing and the second shield is connected to the fairing.

5. The assembly of claim 1, wherein the first shield is mounted to the first casing at a flange and includes a cylindrical portion spaced from the first casing.

6. The assembly of claim 5, and further comprising a support member extending radially from the cylindrical portion of the first shield and connecting a conical portion of the second shield to the first shield.

7. The assembly of claim 6, wherein the second shield is spaced from and not connected to the fairing.

8. The assembly of claim 1, wherein the first casing is disposed radially inward from the second casing.

9. The assembly of claim 1, wherein the third shield is comprised of a plurality of connected arcuate segments.

10. An assembly for a gas turbine engine, comprising:

a first casing;

a second casing;

a plurality of struts extending from the first casing and supporting the second casing;

a fairing between the first casing and the second casing and disposed around each of the plurality of struts;

a multi-piece heat shield assembly comprising:

a first shield extending between the first casing and the fairing;

a second shield extending between the first casing and the fairing;

a third shield extending between the second casing and the fairing; and a plurality of fourth shields connected to the third shield, wherein each fourth shield extends radially from a first end connected to the third shield to a second end radially spaced from the first shield, and wherein each fourth shield extends between a forward-facing side of each strut and the fairing; and a plurality of fifth shields connected to the third shield, wherein each fifth shield extends radially from a third end connected to the third shield to a fourth end radially spaced from the second shield, and wherein each fifth shield extends between an aft-facing side of each strut and the fairing;

wherein each of the first shield, the second shield, and the third shield includes a notch adapted to receive one of the struts.

11. The assembly of claim 10, wherein the second shield includes a conical portion that is spaced from and extends along the fairing.

12. The assembly of claim 11, wherein the second shield is radially spaced from the first shield and extends from the fairing to overlap at least a portion of the first shield.

13. The assembly of claim 10, wherein the first shield is mounted to the first casing at a flange.

14. The assembly of claim 13, wherein the second shield is mounted to the fairing at a rib that extends radially from the fairing.

15. The assembly of claim 10, wherein the third shield is comprised of a plurality of connected arcuate segments.

16. An assembly for a gas turbine engine, comprising:

a first casing;

a second casing;

a plurality of struts extending from the first casing and supporting the second casing;

a fairing between the first casing and the second casing and disposed around each of the plurality of struts;

a multi-piece heat shield assembly comprising:

a first shield extending between the first casing and the fairing;

a second shield extending between the first casing and the fairing;

a third shield extending between the second casing and the fairing; and a plurality of fourth shields connected to the third shield, each fourth shield extending radially between a forward-facing side of each strut and the fairing to connect the first shield to the third shield; and a plurality of fifth shields attached to the third shield, each fifth shield extending radially between an aft-facing side of each strut and the fairing to connect the second shield to the third shield;

wherein each of the first shield, the second shield, and the third shield includes a notch adapted to receive one of the struts.

17. The assembly of claim 16, wherein the first shield includes a plurality of first slots and the second shield includes a plurality of second slots, wherein each first slot is adapted to receive one of the plurality of fourth shields and each second slot is adapted to receive one of the plurality of fifth shields.

18. The assembly of claim 17, wherein each of the plurality of fourth shields includes a first tab adapted to be received in one of the first slots, and wherein each of the plurality of fifth shields includes a second tab adapted to be received in one of the second slots.

19. The assembly of claim 18, wherein the first shield is intermittently connected to the second shield along a circumferentially-extending joint, and wherein the first and second shields are conical.

20. The assembly of claim 19, wherein the first shield and second shields are mounted to the fairing.

* * * * *